US007462792B1

(12) United States Patent
Hellmers et al.

(10) Patent No.: US 7,462,792 B1
(45) Date of Patent: Dec. 9, 2008

(54) POWER TRANSMISSION SAFETY SYSTEM

(75) Inventors: Michael Hellmers, Santa Ana, CA (US); David Hellmers, Carlsbad, CA (US); Denis Crawford, Long Beach, CA (US)

(73) Assignee: ESL Power Systems, Inc., Corona, CA (US)

( * ) Notice: Subject to any disclaimer, the term of this patent is extended or adjusted under 35 U.S.C. 154(b) by 0 days.

(21) Appl. No.: 12/076,023

(22) Filed: Mar. 13, 2008

(51) Int. Cl.
*H01H 9/20* (2006.01)
*H01H 9/26* (2006.01)

(52) U.S. Cl. ..... 200/50.33; 335/160

(58) Field of Classification Search ... 200/50.33–50.36; 335/160, 161; 361/615; 307/328
See application file for complete search history.

(56) References Cited

U.S. PATENT DOCUMENTS

| | | | | |
|---|---|---|---|---|
| 2,494,313 | A | 1/1950 | Rowe | |
| 3,523,166 | A | 8/1970 | Daly | |
| 4,034,170 | A | 7/1977 | Raabe et al. | |
| 5,239,129 | A | 8/1993 | Ehrenfels | |
| 5,568,362 | A | 10/1996 | Hansson | |
| 5,814,777 | A * | 9/1998 | Green et al. | 200/50.33 |
| 6,256,881 | B1 | 7/2001 | Starkey | |
| 6,341,979 | B1 | 1/2002 | Yamamoto | |
| 6,365,990 | B2 | 4/2002 | Flegel | |
| 6,414,240 | B1 | 7/2002 | Flegel | |
| 6,424,060 | B1 | 7/2002 | Shiely et al. | |
| 6,784,385 | B2 | 8/2004 | Hernández-Pérez | |
| 6,849,811 | B1 | 2/2005 | Heflin et al. | |
| 6,861,585 | B1 | 3/2005 | Kiely | |
| 7,030,514 | B2 | 4/2006 | Wareham et al. | |
| 7,136,278 | B2 | 11/2006 | Allen | |
| 2008/0149467 | A1 * | 6/2008 | Somalingayya et al. | 200/50.33 |

* cited by examiner

*Primary Examiner*—Ramon M Barrera
(74) *Attorney, Agent, or Firm*—Rosenberg, Klein & Lee

(57) ABSTRACT

A power transmission safety system is disclosed having a pair of power transmission members, each of the power transmission members having a switch arm. Each of a pair of switch arm engaging members reversibly engage a switch arm of its respective power transmission member. Each of a pair of pivoting shaft members are coupled to a respective one of the pair of switch arm engaging members on one end, and a rotatable handle on an opposing end. An interlocking power activation bar has a pair of openings located thereon, whereby rotation of one of the pivoting shaft members engages a switch arm of a respective circuit breaker into an "on" position and displaces the interlocking power activation bar to lock the other of the shafts from rotating, thereby preventing both of said power transmission members from being "on" concurrently.

20 Claims, 8 Drawing Sheets

POWER TRANSMISSION SAFETY SYSTEM

BACKGROUND OF THE INVENTION

The present invention relates to a power transmission safety system which will mechanically interlock two switches to only allow one to be turned on at any one time. The power transmission safety system includes an interconnect bar that is displaced upon the engaging of one switch assembly such that the other switch assembly cannot possibly be electrically or mechanically engaged. This will permit a lay person or non-professional to install the system and operate it safely without the possibility of electrical injury.

Additionally, the instant invention is directed to a power transmission safety system which will disallow access to the internal components of the power system unless both sources of power are disengaged, i.e. in the "off" position.

The subject invention further pertains to a temporary generator power connection and transfer switch system between main/utility power and a temporary generator power.

Still further, quick access to a socket for a temporary generator coupling with user friendly, color-coding may be provided.

The invention further pertains to providing a quick transition from "on" states to "off" states and similarly, quick transition from "off" to "on", thus preventing arcing and possible personal injury.

DESCRIPTION OF THE PRIOR ART

Power transmission safety systems in use in modern electrical systems typically employ a double pole double throw (DPDT). "break before make" switch to allow a user to switch between utility and generator power. Double throw means that one can place the throw into two different positions with the "off" position not being an actuating or deactuating position. Double throw allows one to throw one way, for example to a power load, or throw in the opposite direction to the temporary generator. This must, of course, be provided for both positive and negative poles, and have a separate throw each for the power load and the generator.

"Break before make" means that it disconnects load from one source before connecting to another source. This is very important in that any connection that combines generator and utility power together could severely damage equipment and potentially cause injury to personnel and technicians working on lines assumed to be "dead".

With a double throw type switch, each of the two opposing throws are separated by an "off" position. This "off" position serves as a break between, for example, line or utility on one hand, and generator on the other. This break prevents arcing, short circuits, and feedback into mains during the transition.

Unfortunately, due to the safety considerations of the dual pole dual throw break-before-make change over switch, many state and federal laws require that a qualified electrician perform the installation, and in some cases even perform the actual throwing of the switch.

This is complicated further in that most homes use a temporary generator that is generally disconnected until needed. Generators of this temporary nature must be operated outdoors unless proper exhaust is installed, which usually incurs large costs. If, to be in compliance with regulations, a certified electrician must come every time the power goes out to make the connection of the temporary generator to the switch-over box, this would be very inconvenient for the user as well as costly and requires that the user go without power until the technician arrives.

There are a variety of products on the market that service the need of switching between generator power and utility power while exclusively isolating the generator from the utility power so as not to cause damage or injury. The premium solution is a dedicated, permanently coupled generator with an automatic transfer switch. This, however, is the most expensive solution and requires routine maintenance on the switch and generator, as well as an initial installation by a certified electrician.

Another prior art method is to install a double throw safety switch either coupled to a dedicated generator or provide means to hardwire a portable generator. This method, however, provides no over current protection and also requires a licensed, certified electrician to connect the generator to the switch and provide regular maintenance. The over current protection problem could be solved by using a fusible double pole safety switch. However, this then requires that replacement fuses be kept on hand if needed and could indeed expose individuals to live parts when replacing the fuses, thus endangering lives.

Thus, one problem associated with conventional power switches is the exposure to residents and technicians, even remote from the site under feedback conditions, of live electrical current.

Another problem associated with conventional transfer switches is the susceptibility to a non-mutually exclusive connection whereby electrical devices and/or people could be damaged or injured.

Yet another problem associated with conventional transfer switches is the need for a certified electrician for initial install and maintenance and repair with the costs associated therewith being borne by the user. This makes conventional approaches unattractive and unaffordable to the average household.

The best art known to Applicants include U.S. Pat. Nos. 2,494,313; 6,414,240; 6,861,585; 5,568,362; 6,424,060; 6,256,881; 3,523,166; 5,239,129; 6,849,811; 7,030,514; 6,341,979; 7,136,278; 2002/0000757; 4,034,170; and, 6,784,385.

Prior art systems such as that shown in U.S. Pat. No. 4,034,170, which is directed to an electrical transfer switching apparatus and has a dissimilar door interlock and plural switch interlock. The electrical transfer switching apparatus of the '170 reference has one edge handle that could be, for example, pushed upwards to engage utility power, or pulled all the way down to engage the generator power. The handle communicates to the inside of the enclosure where an elongated operating slide transfers the arcuate movement of the handle to a linear slide to activate either a first rotary switch representing utility power, or a second rotary switch representing the generator input.

The '170 reference appears to be limited to edge mounted blade switches. There is provided no ability to work with off-the-shelf type switches or standard uniform type circuit breakers that are able to provide over current protection or instantaneous state transfer as in the subject patent application.

Further the '170 reference is dependent upon a plurality of turned-in tabs to follow L-shaped guides which will transfer linear motion of the elongated operating slide into rotary movement to engage alternatively the utility rotary switch or the generator rotary switch. It is believed that with the failure of any one of the plurality of turned in tabs, that the system could lead to an improper and dangerous operating condition.

For example, were the turned-in tab to become un-lodged from the transfers elongated slot formed in the elongate operating slide it could be that the user believes they are turning power "off" when in actuality the main power is still left "on". In this situation the user would be able to open the cover and access the internal components and erroneously believing them to be deactivated, could cause grievous bodily injury to themselves.

Further, were a user to attempt to unlodge the turned in tab from the operating slide and attempt to manually engage the generator, believing utility was disconnected when in fact it was not, disastrous consequences could ensue including the destruction of the generator, and/or a back feeding event where utility workers (even those far removed from the users box) may be electrically injured.

Additionally, there is a possibility that a turned in tab could become dislodged from the elongated operating slide in an "on" position and when the elongated operating slide reciprocates in the opposing direction, thus engaging the opposite switch, a user may encounter a situation where both switches are "on" concurrently which could cause a back feeding event resulting in injury and/or damage to generating equipment.

Still further, with the mere provision of line terminals it is believed that this is more suited for a permanent installation of generator rather than a selective coupling/decoupling of a temporary generator. There also is not a connector capability or a color code for indicating proper port positioning.

It is believe that a certified electrician will be needed to install/uninstall the generator transfer safety system, initially, and provide routine maintenance. Still further, this system would require the licensed technician at each coupling of a generator.

It is also believed that this reference is mechanically limited to edge mounted blade switches. There is provided no ability to work with off-the-shelf universal type switches or standard uniform type circuit breakers that would be able to provide over current protection or instantaneous state transfer as in the subject patent application.

U.S. Pat. No. 6,784,385 is directed to an electrical transfer switch that is used to shift the load from a normal power supply to an emergency power supply. Selection is made on the exterior of an enclosure by means of a handle that is located on the lower panel of the enclosure. Internally, the handle activates one set of switches for utility power, or another set of switches for generator current. With this configuration, however, it is believed that there is still the possibility that both utility power and generator could be connected to the same circuit at the same time, thus, also leading potentially to backfeeding situations, dangerous/life threatening situations, and/or destruction of equipment.

Further, no provision is made for connector capability and therefore, it is believed that once again a certified electrician is necessary for installation, routine maintenance, and each coupling of a temporary generator.

Still Further, the '385 reference does not appear to provide an ability to work with off-the-shelf type switches or standard uniform type circuit breakers that would be able to provide over current protection or instantaneous state transfer as in the subject patent application.

Pre-grant Publication 2002/0000757 is directed to a cover plate terminal assembly for a transfer switch. The transfer switch assembly provides for the connection of an emergency generator to the electrical system of a building using tubular cells whereby bare wire is inserted into one of the tubular cells and connection is made by means of tightening a threaded head member to establish the electrical connection thus also necessitating a certified electrician for the installation, routine maintenance, and each coupling/decoupling of a generator.

U.S. Pat. No. 7,136,278 is directed to an enclosed electrical switch gear and method of manufacture. The switch gear comprises a main body and encloses a main breaker separated from the connector portion by means of a connector cover and accessed by means of holes. Connections are made by connecting connectors and may take the structure of various leads, cables, or connectors.

U.S. Pat. No. 6,341,979 is directed to an electrical connector and shows an example of a male-female type inter connection along with a color coded insulation boot in order to identify the connections such as phases, neutral, or ground connections.

Therefore, the previous state of the art does not provide for a power interconnect safety transfer switch enclosure whereby a temporary generator can be quickly and easily coupled and uncoupled, a non-certified user being able to legally and safely transfer power from utility to generator, back feeding events are prevented, access is prevented when either of two sources are live, the activation of one power source prevents activation of the other source, and modularity is afforded to allow the use of universal, off-the-shelf switches or breakers which can provide over-current and instantaneous state transitions, among other benefits.

SUMMARY OF THE INVENTION

An enclosure in which is contained two separate power transmission members or disconnection means (circuit breakers or switches), hereinafter referred to as "switch assembly" but used interchangeably, a power distribution means, and an inlet for an alternate power source. The primary power source is connected to one of the switches. The load side of the switch is connected to the power distribution means. The alternate power inlet is connected to the second switch. The load side of the second switch is connected to power distribution means, creating a common load for the two switches. The two switches are mechanically interlocked so that only one switch (therefore only one power source) can be on at any one time (break before make).

Further, an additional safety feature is that the rotatable handles are connected to the ends of internal shafts and will only be decoupleable in the "off" position, therefore both handles must be in the "off" position before the door is able to open to allow access to the internal compartment of the enclosure. This ensures that access is not provided to a "live" box.

Providing more safety is a temporary power source connection port or socket whereby a temporary generator or similar device can be attached by anyone, and not solely a certified electrical technician. Aiding in this connection process is a color coding of connectors.

Still further, the enclosure, and frames which couple and secure the shaft and switch actuating arms are able to receive circuit breakers, switches, or any universally shaped, off-the-shelf switch type element to allow for over-current protection and instantaneous state transfer to prevent arcing.

The invention of the subject patent application combines the safety, reliability, instantaneous state transfer, and the over current protection of circuit breakers with the convenience and safety of a receptacle in a single enclosure that is able to be operated without certification, licensing, or permits.

The disconnects or switches being externally operated by the use of an externally mounted handle, shaft and operator mechanism. The operator mechanism on each of the disconnects are mechanically interlocked such that only one disconnect can be in the "on" position at any one time. The internal circuits are shielded from access by a user unless both circuits are in the "off" position. Still further, an easy connection port for temporary power and color coded connections are provided for ease of use.

Further there is a locking element that allows the user to selectively lock "off" a switch such that it cannot be engaged.

Still further, a mounting system provided internal to the box allows the box to receive any standard, uniform, or off-the-shelf switch or circuit breaker.

DESCRIPTION OF THE PREFERRED EMBODIMENTS

Figure 1:
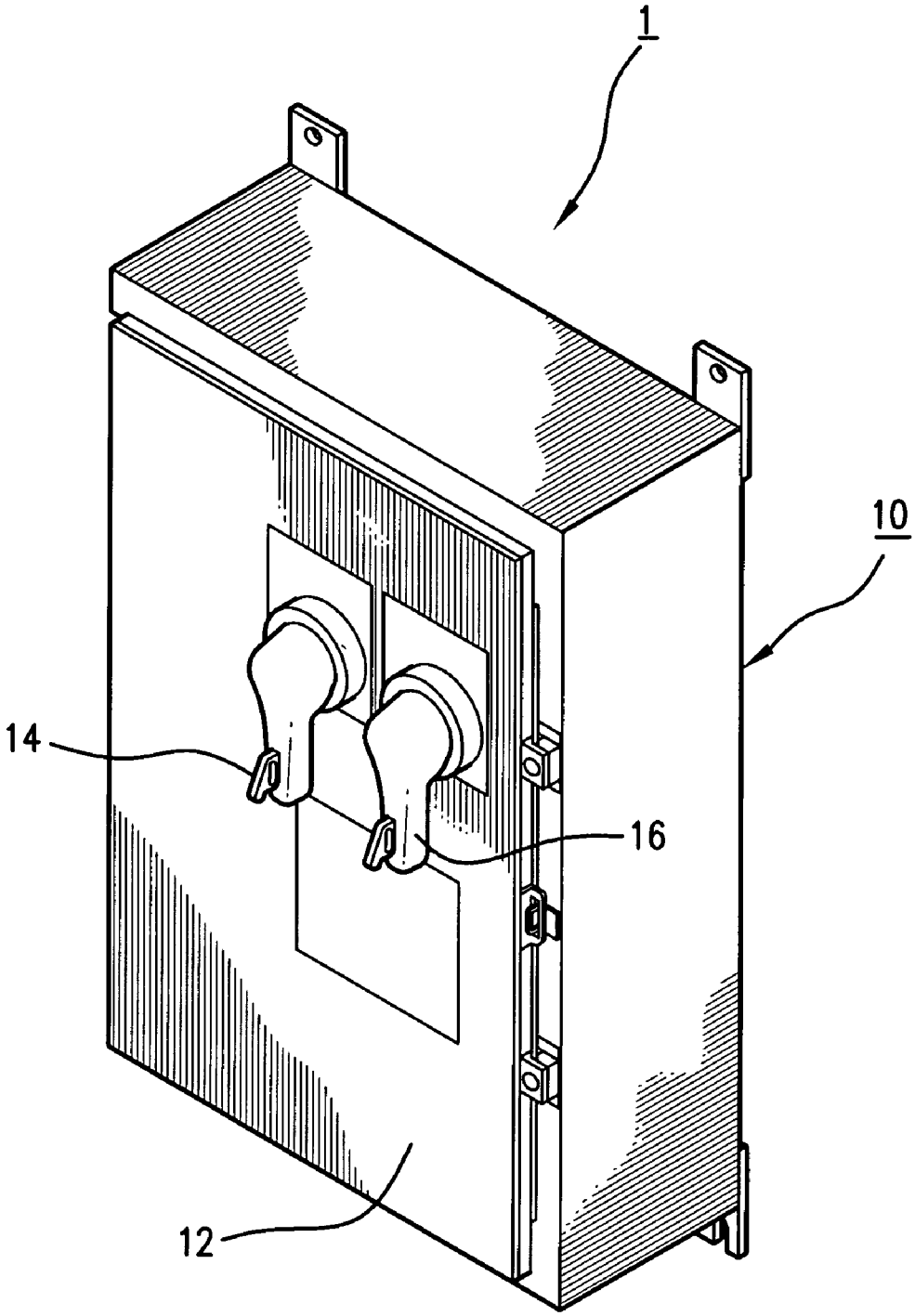
FIG. 1 is a perspective drawing of an enclosure with both handles in the "off" position.

Referring to FIG. 1, there is shown a generator power interconnection and transfer switch system 1. The generator power interconnection and transfer switch system 1 includes a first rotatable handle 14 and a second rotatable handle 16 mounted on a door 12 of an enclosure 10. Initially, door 12 is closed, but to allow opening, both pivoting handles 14 and 16 must be rotated to an "off" position as shown in FIG. 1 with a vertical alignment of the main axis of each handle.

Door 12 can be mounted to enclosure 10 along a lateral side, and pivot to an open position. Optionally, a rubber or elastic annular seal can be provided to ensure that the enclosure is water resistant. Further, screw clamps can be provided at a periphery to further compress the rubber or elastic seal and ensure it is water-tight.

Figure 2:
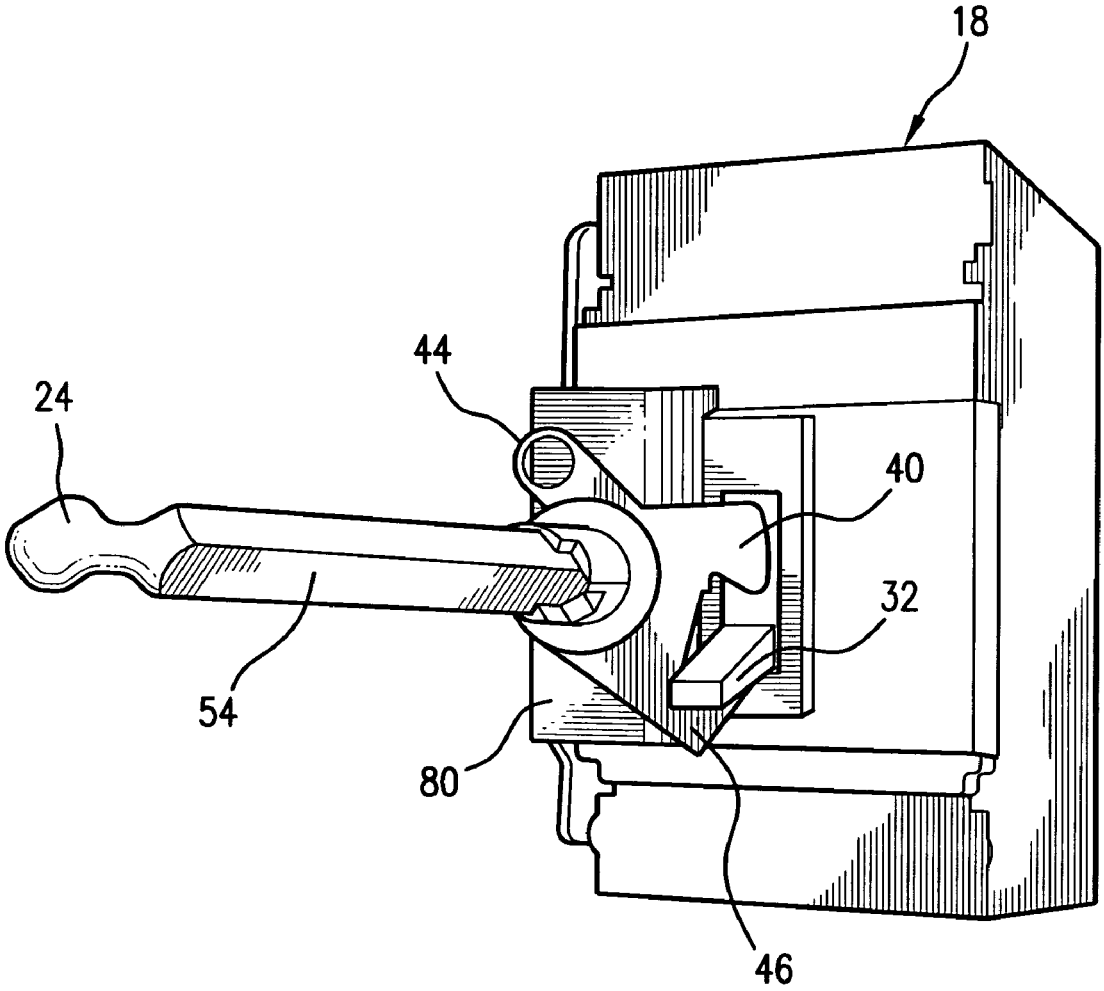
FIG. 2 is a perspective view of a typical switch assembly to be used internal to the enclosure.

As can be seen in FIG. 2, mounting frame 80 decoupleably captures a switch assembly 18 which may be a circuit breaker or a standard switch and couples a shaft 54 having a proximal end 24 which couples to a corresponding rotatable handle 14 on the exterior of door 12 through a through hole 100 (shown in FIG. 5) defined through door 12. This allows a rotational motion to be imparted on handle 14 or 16 to apply rotational torqueing force on the shaft 54 which is coupled with a switch actuator arm 40 which will take the rotary torqueing force and apply it to actuate the switch arm 32.

When there is a counterclockwise movement from the "off" position, the lower actuator arm 46 engages the switch arm 32 in an upwards movement to displace the switch arm 32 to an "on" position. Alternatively when the handle transfers from an "on" position to an "off" position, a clockwise torqueing force is imparted on the shaft 54 which actuates the upper actuating arm 40 and imparts a downward motion to the switch arm 32 which deactivates the switch assembly 18.

Again, switch assembly 18 may be a circuit breaker, a switch, or any other universal type of device which has a front mounted engagement device. Preferably, switch assembly 18 incorporates a means for ensuring an almost instantaneous state transfer such as a spring or resilient member internal thereto to prevent arcing and other improper electrical conditions. A circuit breaker may be advantageous as it would incorporate this instantaneous state transfer, and also incorporate over-current protection.

Door 12 has two through holes with handles 14 and 16 being mounted pivotally thereon, over the through holes. When either of the handles are rotated to an "on" position, they de-coupleably engage a respective shaft 54 or 56 contained in the enclosure. Conversely, when a handle 14 or 16 is rotated back to an "off", the respective shaft 54 or 56 is released. In this manner, the door is able to be opened only when both handles 14 and 16 are in the "off" position.

Figure 3:
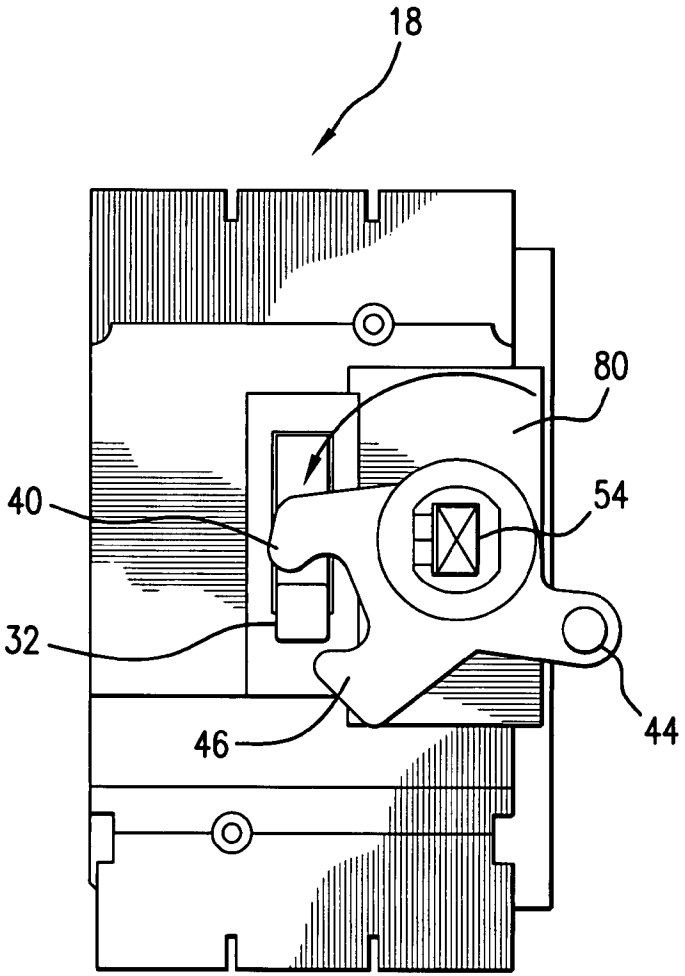
FIG. 3 is an elevational view of a switch assembly in an "off" position.

As seen in FIG. 3, a counterclockwise rotational force applied to shaft 54, driven by the rotatable handle 14 progressing from an "on" position to an "off" position, will impart this rotational force on actuator arm 40, which will impart a downward force on switch arm 32 which will disconnect the switch assembly 18.

Figure 4:
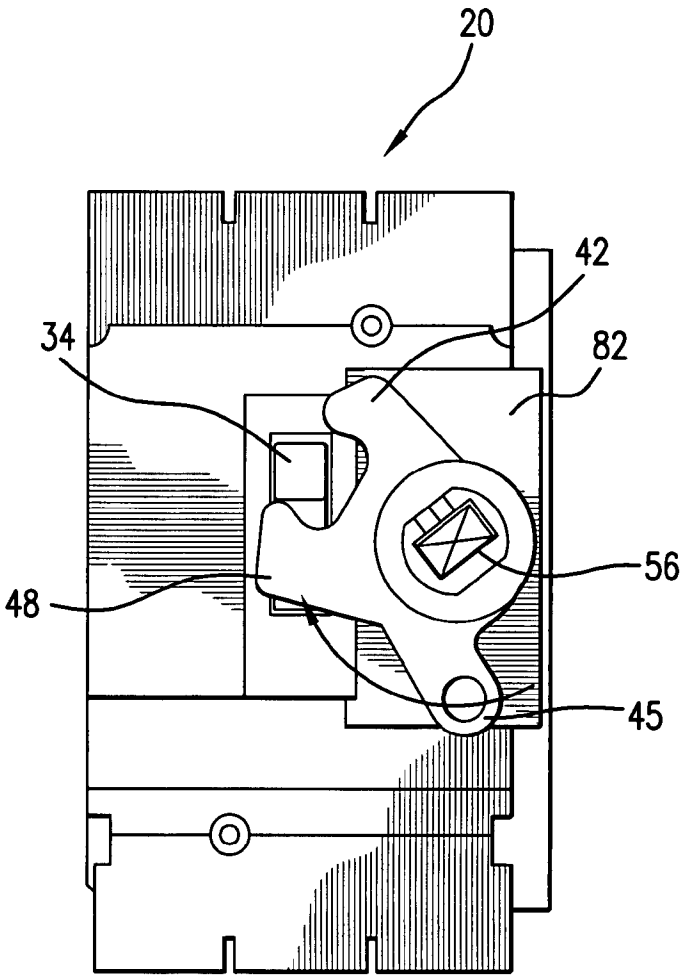
FIG. 4 is an elevational view of a switch assembly in an "on" position.

As seen in FIG. 4, a clockwise torqueing rotary force on the shaft 56, driven by the rotatable handle 16 progressing from an "on" position to an "off" position, will impart this force on actuator arm 48 which will provide an upwards directed force on switch arm 34 and thus activate the switch assembly 20.

Also seen in FIGS. 3 and 4 are frame members 80 and 82 which decoupleably capture a circuit-breaker, or switch assembly 18 and 20 and position shafts 54 and 56 and their respective actuator arms in an interacting arrangement with switch arms 32 and 34 of switch assemblies 18 and 20 respectively.

Figure 5:
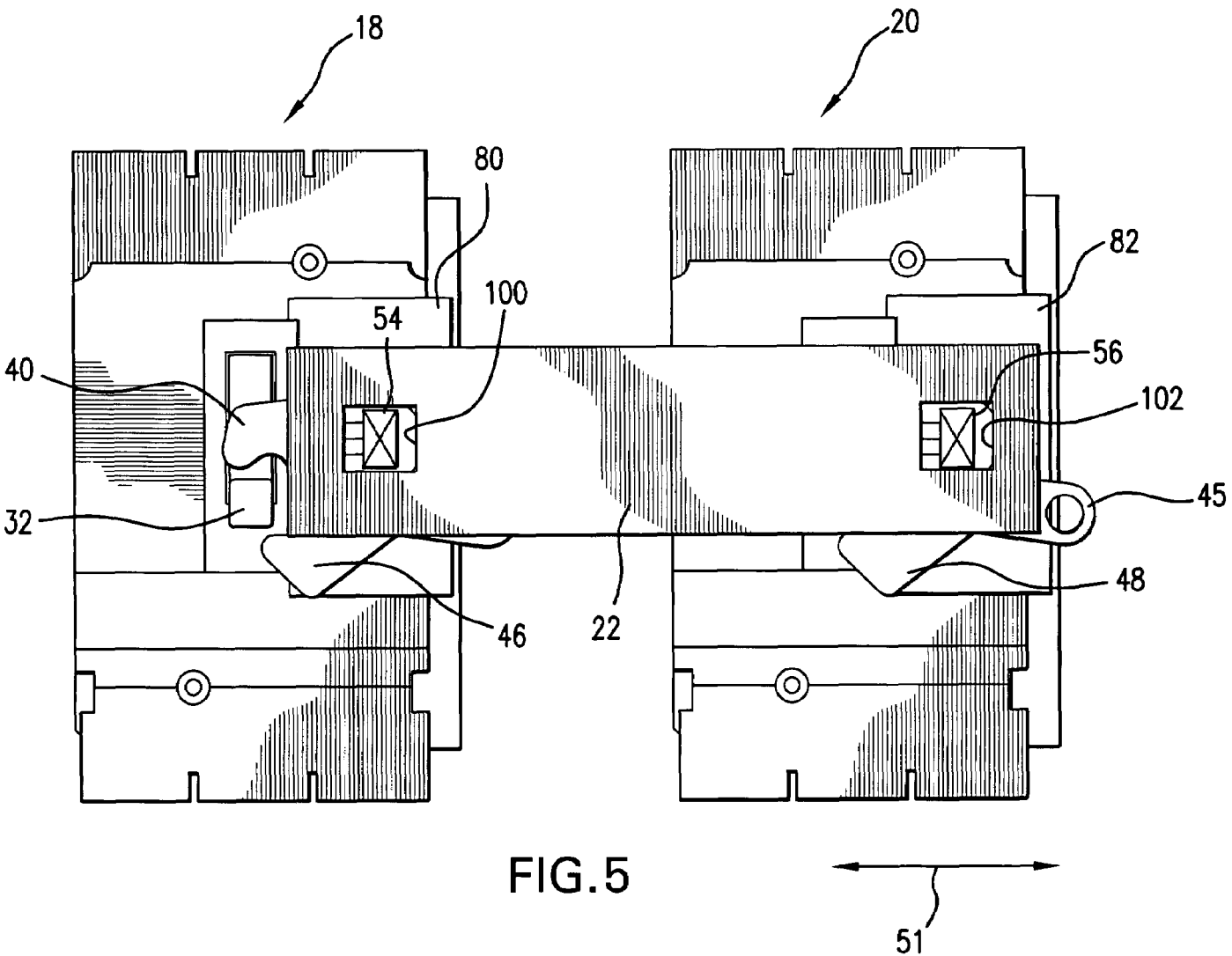
FIG. 5 is an elevational view of two switches assemblies interlocked, both being in the "off" position.

FIG. 5 shows a preferred embodiment of the invention of the subject patent application. Two switch assemblies 18 and 20 are used in concert side by side within the box 10 covered by the door 12. Inside, the two switch assemblies 18 and 20 are positioned side by side with frame structures 80 and 82 which couple the universal switch/circuit breaker to a respective pair of actuating arms 40/46 and 42/48 to use the rotary force to activate a switch arm 32 or 34. As shown here, each pair of the actuator arms are coupled to the shafts 54 and 56 respectively, and are located underneath interlocking bar 22.

Interlocking bar 22 is a bar with two through passages 100 and 102 which are polygonally contoured and may be square or otherwise contoured. Each of the through passages 100, 102 allows a respective shaft 54 or 56 to pass therethrough. On engagement of a handle 14 or handle 16, a respective shaft 54 or 56 rotates clockwise into an "on" position which will initially rotate a respective actuator arm 46 or 48 into engagement with switch arm 32 or 34 and simultaneously rotate shaft 54 or 56 such that the rectangular cross-section thereof will introduce a greater radial distance and thus induce linear movement of the interlocking bar 22 towards the engaged handle 14 or 16. This movement of interlocking bar 22 laterally will reduce the clearance of an opposing (non-engaged) shaft 54 or 56 such that it is no longer able to freely rotate into an "on" position. This ensures that if either of the two switches are engaged, the other is mutually excluded therefrom.

For example, were handle 14 to be rotated to an "on" position, shaft 54 rotates in a clockwise manner and thus the radial distance is expanded in an x direction 51, thus imparting linear motion on the interlocking bar 22 towards switch assembly 18 which reduces the clearance of the opposing shaft 56 with through hole 102 such that there is no clearance or at least a small enough clearance such that shaft 56 cannot also be engaged while shaft 54 is engaged. For this to function properly, interlocking bar 22 should not be of an elastic composition, but rather a rigid composition formed of metal or some like composition not important to the invention concept, with the exception that it is capable of accepting the loads imparted. Similarly, shafts 54 and 56 should also be rigid and non-elastic.

When handle 14, on the outside case, is reversed back to an "off" position the shaft 54 will rotate counterclockwise such that the radial distance is reduced in direction 51 and the lateral force is removed, the clearance is increased, and interlocking bar 22 is again free to move. This allows the engagement of the opposing switch assembly 20 corresponding with the shaft 56 which now has a clearance allowing it to be engaged. As can clearly be seen herein it is not possible for both switches to be engaged concurrently. Interlocking bar 22 mechanically prevents this from happening by imparting a force that is not able to be overcome.

Figure 6:
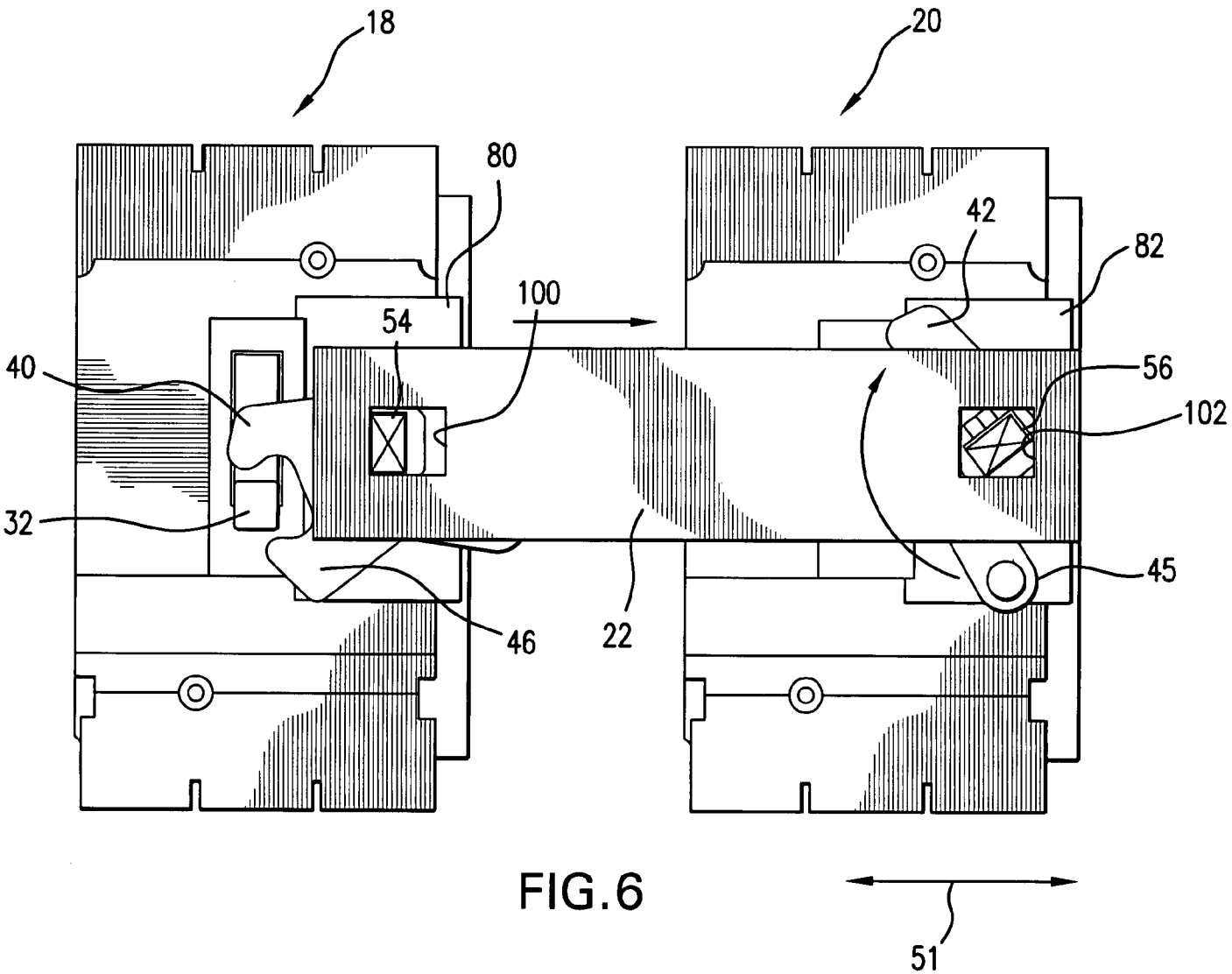
FIG. 6 is an elevational view of a first or a right switch assembly in the "on" position, and the rightwards lateral movement of the interconnect bar to lock "off" the second or left switch assembly.

As seen in FIG. 6, shaft 54 and handle 14 connected thereto (not shown) remains in an "off" position, while shaft 56 and handle 16 connected thereto (not shown) has been rotated from an "off" position into an "on" position. As is seen, shaft 56 of rectangular or polygonal cross-section, is rotating in a clockwise manner corresponding to the rotation of the handle 16 such that the radial distance (with respect to shaft 56-interlocking bar 22 interface) is increasing as the leading edge is imparting a linearly "right" directed force against an inner wall of through hole 102 of interlocking bar 22 thus causing it to slide right and reduce the clearance between the through hole 100 and the opposing shaft 54. In this manner, when the handle 16 reaches the terminal end of its path and actuating arm 48 has imparted motion to switch arm 34 such that it is now in an "on" position, interlocking bar 22 will remain at a far right extreme and a clearance of the left through hole 100 with shaft 54 will remain in a reduced condition such that shaft 54 may not be actuated while handle 16, shaft 56, actuator element 48, and switch arm 34 are in an engaged, or "on" position.

Optionally, lock-off 45 allows a padlock or other security device to manually lock-off either, or both, switches. In the event a lock was installed, shaft 56 would not be able to rotate to an "on" position.

The terminal end of the path to the "on" position of handle 16 is shown. As can be seen, corresponding shaft 56 has now rotated approximately 45° such that a greater radial dimension is occasioned upon interlocking bar 22 such that it is forced to the right further than if shaft 56 were in its at-rest, or "off" position, as the horizontal dimension would be greatly reduced in the radial direction. As this actuating arm 48 has imparted the actuation to switch arm 34 and shaft 56 has been rotated about 45° and is exerting force on to the corresponding planar face of the through hole 102 of interlocking bar 22, it can clearly be seen that any rotary force attempted to be imparted on handle 14 and shaft 54 would be completely ineffectual at moving interlocking bar 22 or shaft 56. Only the switching of handle 16 back to its "off" position would enable the actuation of handle 14 and its transmission shaft 54.

Figure 7:
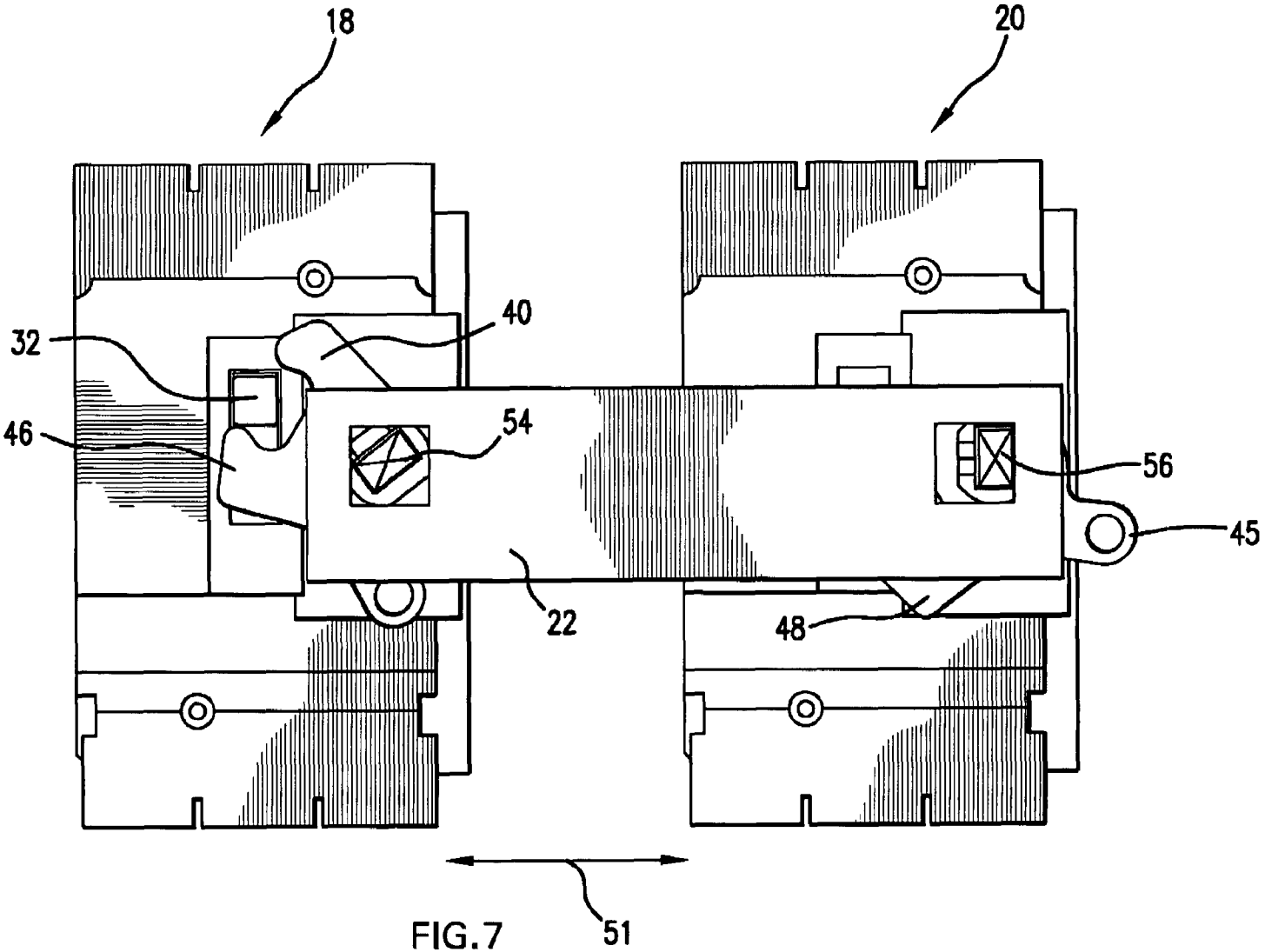
FIG. 7 is an elevational view of the second or left switch assembly in the "on" position and a lateral movement of the interconnect bar to the left thus precluding the first or right switch assembly from being activated.

As can be seen in FIG. 7: shaft 54 and handle 14 connected thereto (not shown) has been rotated "on" from an "off" position. As such, handle 14 and corresponding shaft 54 are rotated in a clockwise fashion and the greater radial distance of the corner is imparting a linear motion on interlocking bar 22 in a leftwards direction. This leftwards direction will reduce the clearance between the through hole 102 on the right hand side and the shaft 56 of switch assembly 20. As the clearance has been reduced and the planar face of shaft 56 is abutting against the planar inner wall of through hole 102 of the right side of the interlocking bar 22, it is necessarily precluded from rotating into an "on" position. Therefore, it is mechanically prevented from engaging while switch assembly 18 is engaged. It can be seen that as shaft 54 completes its clockwise rotation, having traveled about 45°, shaft 54 will be radially protruding a greater amount and abutting the inner wall of through hole 100 of interlocking bar 22 and thus imparting the force thereon. At the end of this travel, actuating arm 46 will have imparted linear motion to switch arm 32 thus engaging it to the upper extent as marked.

Once shaft 54 has completed its rotation to the "on" position, it will not be possible for shaft 56 to rotate because interlocking bar 22 is non-elastic and shaft 56 is non-elastic. Indeed it will be impossible to rotate shaft 56 into an engaged position until shaft 54 has been counter rotated in a counterclockwise manner such that the side with lesser radial dimensionality of the shaft's 54 cross-section is presented to interlocking bar 22 and thus the radial distance is less, therefore allowing a clearance for shaft 56 to rotate and thereby engage.

In an alternative embodiment a single or a plurality of springs may be engaged to interlocking bar 22 such that after either shaft has engaged the interlocking bar 22 and then disengaged and counter rotated such that the clearance is again increased, springs could return the interlocking bar 22 to an at-rest position.

Alternatively, a resilient member may provide a biasing force to return interlocking bar 22 to an at rest position where a clearance exists between both shaft 54 and its respective inner wall of through hole 100; and shaft 56 and its respective inner wall of through hole 102.

Figure 8:
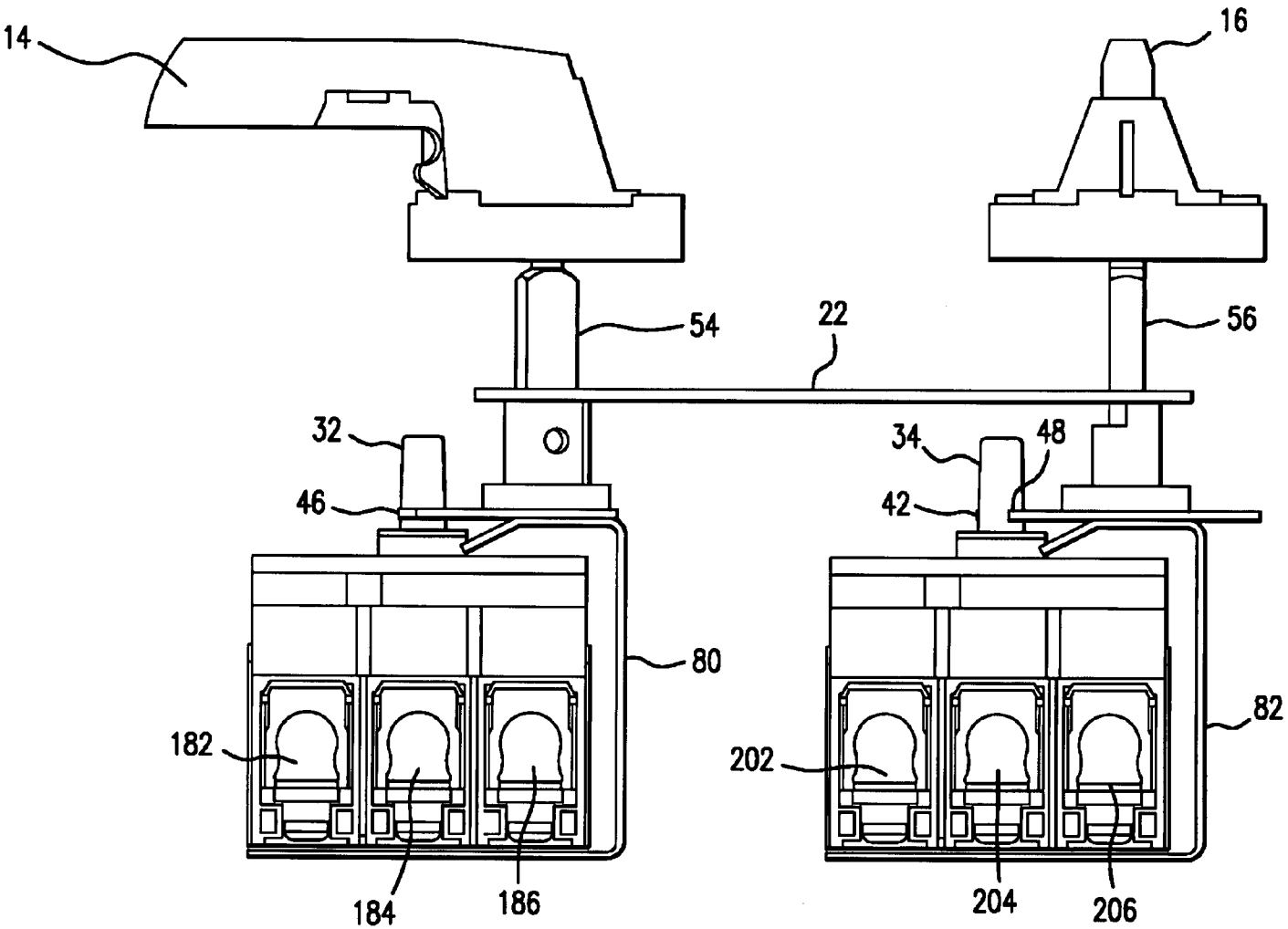
FIG. 8 is a plan view of the underlying structures for supporting shafts and interconnect bar and handles and shows the left switch assembly being activated, a leftward lateral movement of the interconnect bar and preclusion of engagement of the right switch assembly; easy access sockets are also shown.

FIG. 8 shows a configuration similar to FIG. 7, except that the view is rotated in a downward plane by about 90°. As can clearly be seen, handle 14 has been rotated from the "off" position, as handle 16 is in, to an "on" position. The handle will rotate from pointing downwards or directly at the viewer as seen in FIG. 7, to being at about 45°, presenting an almost entire lateral face of handle 14 to the user as in FIG. 8. This rotationally clockwise movement is imparted to shaft 54, which is reversibly coupled to the handle 14. Therefore, shaft 54 will rotate, mirroring the rotation of handle 14. As is seen in the Drawings, especially FIG. 8, the cross-sectional shape of shaft 54 or 56 is a rectangular or polygonal one, where a pair of lateral faces have greater radial extension than an orthogonal pair of faces.

Therefore when either handle 14 or 16 is in an "off" position, its corresponding shaft 54 or 56 will have the least dimensionality in direction 51. Shaft 56 illustrates this as it is narrower in the direction 51 in FIG. 8 than shaft 54.

It can be seen that when handle 14 has been rotated 45° to its "on" position, corresponding shaft 54 has much more dimensionality in the direction defined by arrow 51. As the handle 14 rotates from the "off" position to the "on" position, this dimensionality is increased and this increasing radial dimensionality imparts a linear motion on an inner sidewall of a corresponding through hole 100 of interlocking bar 22 which will be induced to move through that growing radial dimensionality in a direction towards the handle which is being actuated. It is important that this interlocking bar 22 be rigid, and substantially non-elastic. As such, when the bar is induced to move in a direction towards the handle which is being actuated, the through hole corresponding to the opposing end which is on the non-actuated handle and shaft will move, mirroring the movement of the opposing end and will reduce the clearance between shaft 56, or the non-actuated shaft, such that it is unable to be actuated.

Turning again to switch assembly 18, it can be seen that as handle 14 rotates into an "on" position from an "off" position, coupled shaft 54 rotates, interlocking bar 22 is induced to move in a lateral direction toward switch assembly 18, the lower actuating arm 46 imparts a force against switch arm 32 such that it is actuated. Opposingly, handle 16 remains in an "off" position, shaft 56 remains in an "off" position, interlocking bar 22 has been induced to move leftwards towards switch assembly 18, and thus the clearance between an inner wall of through hole 102 of the interlocking bar 22 corresponding with the switch assembly 20 and shaft 56 is reduced. As shaft 56 remains unmoved, the lower actuating arm 48 has not been actuated and as is seen, actuating arm 48 has not moved to occlude a portion of switch arm 34. As is visible to the left of switch arm 34, a small portion of the upper actuating arm 42 of the switch assembly 20 is visible.

In FIG. 8, it can be seen that handles 14 and 16, shafts 54 and 56, their respective couplings to the actuating arms 40, 42, 46, and 48 and each of the respective assemblies coupling to frame 80 and frame 82 is disposed so as to receive any universal switch, disconnect, power transmission member or circuit breaker element. This will allow flexibility in configuration, ease of repair/replacement, and upgrade.

On the bottom face of each of switch assemblies 18 and 20 are a plurality of easy access connectors 182, 184, 186 and 202, 204, and 206 respectively. This will allow easy install or removal of positive, negative, and ground connectors to the respective switch or circuit breakers. It is believed to be apparent to one reasonably skilled in the art that a pinch connector, clamp, clamping mechanism, or easy access friction locking member could serve this intended purpose.

In a further embodiment it is possible that each of the respective easy access connectors 182/202, 184/204, or 186/206 may be color coded in an easily ascertainable manner for the non-certified electrical type person such that a lay person could install the generator electrical cables. For example, red, white, and black could be used.

Still further, easy access connectors 202, 204, and/or 206 corresponding with the switch for the temporary generator, may be replaced by a socket type connector to take a standard input from a temporary generator and allow easy coupling and decoupling for lay people without necessitating a housecall from a certified electrician.

Still further this socket type connector may be positioned external to said enclosure such that the enclosure would not need to be opened to access this function.

Optionally, the socket may be housed within the enclosure, however, facing an external wall where the wall could have a easy remove protective cover such that the socket could be accessed without using the door 12.

Optionally, the enclosure may be powder-coated to provide a professional and long-lasting appearance. In a preferred embodiment both utility and generator amperages could be accommodated that range from 100 amps up to 600 amps.

Switch assemblies 18 and 20 could be circuit breakers or molded case switches on both the utility and generator side or mixing and matching could be accommodated as well. Still further voltage ranges of up to 240 vac, 480 vac, or 600 vac could be accommodated. Yet further three phase, neutral plus ground (5 cams), or 3 phase plus ground (4 cams) could be accommodated and color coded for easy access, installation, maintenance and/or removal.

To better withstand adverse conditions, the enclosure can be optionally fabricated from stainless steel or a cold rolled steel. To even further prevent corrosion, and withstand adverse environments, a plurality of latches on the side of the box with tightenable screws to exert a further force against the door and the enclosure to ensure a sufficient sealing force could be optionally installed.

Figure 9:
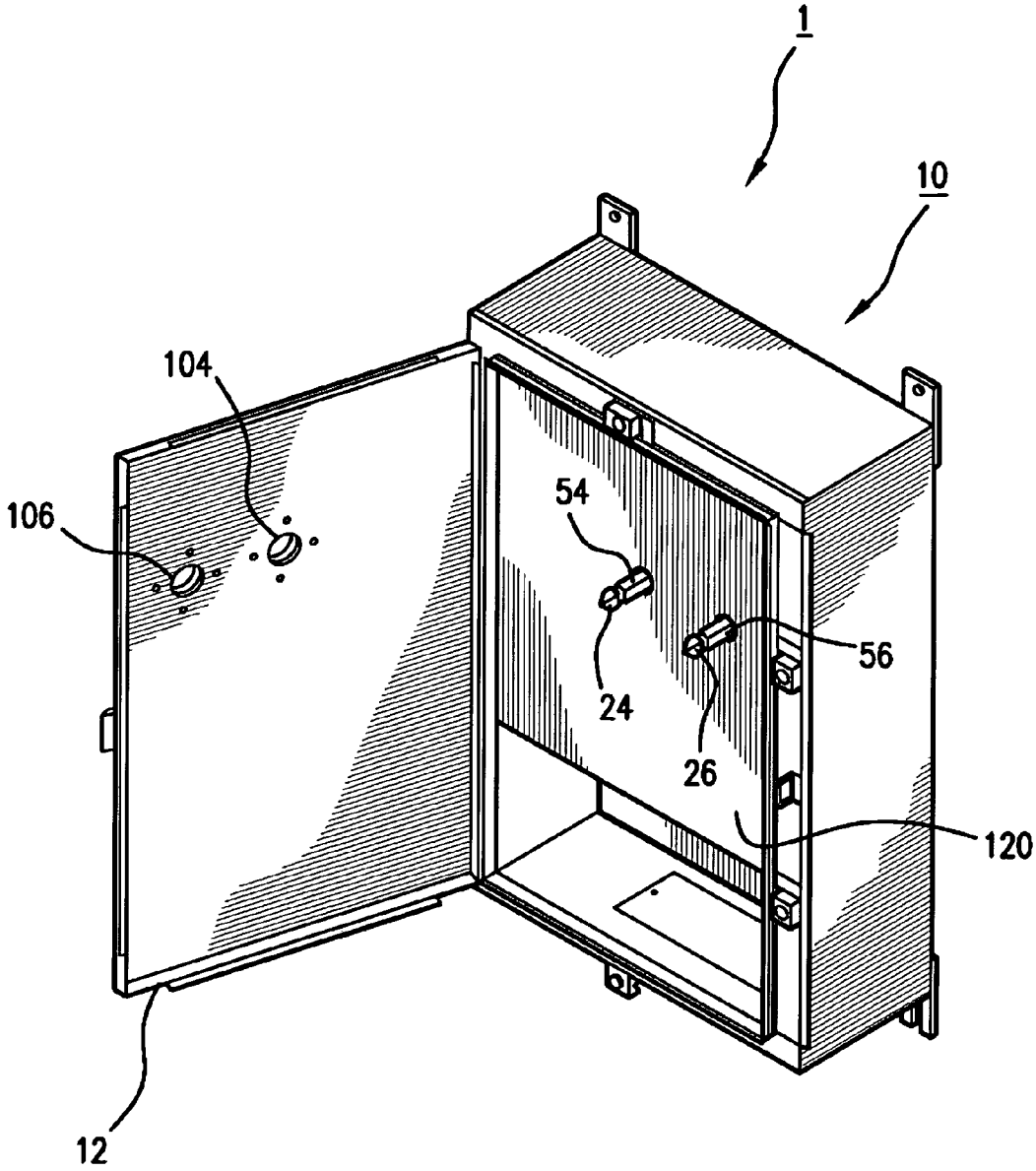
FIG. 9 is a perspective drawing of an enclosure with the door open.

Optionally, a wall could be accommodated internal to the housing 10 as seen in FIG. 9. In this case, two through holes would allow shafts 54 and 56 to pass therethrough. This would obstruct access to the mechanical chamber containing the switch assemblies and interlock bar. This wall could optionally be removable. When the door is closed, Shafts 54 and 56 will pass through through-holes 104 and 106 respectively defined in the door 12. The ends 24 and 26 of shafts 54 and 56 respectively will reversibly couple to a respective handle 14 and 16.

Still further, optionally, the handles 14 and 16 could be locked in rotational position by means known to one reasonably skilled in the art unless a trigger, or release is first actuated, or actuated while turning. This would have the added advantage of preventing an accidental deactivation of utility power or generator power. To prevent children from activating, or an unintentional operation, the force required for actuating the trigger or release could be adapted to be suitably above the force able to be exerted by an average child.

It will be appreciated by those skilled in the art that changes could be made to the embodiments described above without departing from the broad inventive concept thereof. It is understood, therefore, that this invention is not limited to the particular embodiments disclosed, but is indeed intended to cover modifications within the spirit and scope of the present invention as defined by the appended claims.

What is claimed is:

1. A power transmission safety system comprising:

a pair of power transmission members, each of said power transmission members having a switch arm;

a pair of switch arm engaging members, each reversibly engaging a switch arm of a respective power transmission member;

a pair of pivoting shaft members, each coupled to a respective one of said pair of switch arm engaging members on one end, and a rotatable handle on an opposing end;

an interlocking power activation bar having a pair of openings positionally located on said interlocking power activation bar at a displacement substantially equal to a distance between said switch arms of said power transmission members, whereby rotation of one of said pivoting shaft members engages a switch arm of a respective power transmission member into an "on" position and displaces said interlocking power activation bar transversely to lock the other of said shafts from rotating, thereby preventing both of said power transmission members from being "on" concurrently.

2. The power transmission safety system as recited in claim 1, wherein the power transmission safety system is contained in an enclosure having a door.

3. The power transmission safety system as recited in claim 2, wherein said door has a pair of through-holes and said pair of pivoting shaft members pass therethrough.

4. The power transmission safety system as recited in claim 3, wherein the pair of rotatable handles are disposed on an outer face of said door and are decoupleably mated to said pair of pivoting shaft members.

5. The power transmission safety system as recited in claim 4, wherein each of said pair of rotatable handles are decoupled from a respective one of said pair of pivoting shaft members when rotated to an "off" position.

6. The power transmission safety system as recited in claim 5, wherein said door is only capable of opening when both of said pair of rotatable handles are rotated to an "off" position.

7. The power transmission safety system as recited in claim 1, wherein each of said pivoting shaft members passes through a respective opening of said interlocking power activation bar.

8. The power transmission safety system as recited in claim 7, wherein each of said pivoting shaft members are rectangular in cross-section.

9. The power transmission safety system as recited in claim 8, wherein each of said pair of openings of said interlocking power activation bar has a predetermined distance between a wall of each of said openings and a wall of a respective pivoting shaft member.

10. The power transmission safety system as recited in claim 9, wherein upon a rotatable handle being rotated to an "on" position, a respective pivoting shaft member is correspondingly rotated, a respective switch arm engaging member is correspondingly rotated, and a respective switch arm of a respective power transmission member is engaged to an "on" position.

11. The power transmission safety system as recited in claim 10, wherein upon one of said rotatable handles being positioned to an "on" position, a respective pivoting shaft member, having a rectangular cross-section, displaces said interlocking power activation bar.

12. The power transmission safety system as recited in claim 11, wherein said interlocking power activation bar is displaced linearly by a cam-type action of said respective pivoting shaft member rotating.

13. The power transmission safety system as recited in claim 12, wherein said interlocking power activation bar is displaced to a lateral side of a first power transmission device of said pair of power transmission devices, whereby a clearance of an opening of said interlocking power activation bar corresponding with a pivoting shaft of a second power transmission device is reduced, whereby, said pivoting shaft of a second power transmission device is unable to rotate.

14. The power transmission safety system as recited in claim 13, wherein a switch arm of a second power transmission device is unable to be actuated.

15. The power transmission safety system as recited in claim 12, wherein said interlocking power activation bar is displaced to a lateral side of a second power transmission device of said pair of power transmission devices, whereby a clearance of an opening of said interlocking power activation bar corresponding with a pivoting shaft of a first power transmission device is reduced, whereby, said pivoting shaft of a first power transmission device is unable to rotate.

16. The power transmission safety system as recited in claim 15, wherein a switch arm of a first power transmission device is unable to be actuated.

17. The power transmission safety system as recited in claim 12, wherein said interlocking power activation bar is displaced laterally towards an actuated handle, whereby the clearance is reduced between said interlocking power activation bar and a pivoting shaft member corresponding to a non-actuated handle such that said pivoting shaft member corresponding to a non-actuated handle is prevented from rotating.

18. A power transmission safety system comprising:

an enclosure defining an internal receiving space;

a door coupled to said enclosure, said door having a pair of through-holes;

a pair of rotatable handles disposed on an outer face of said door;

a pair of power transmission members disposed within said internal receiving space, each of said power transmission members having a switch arm;

a pair of switch arm engaging members, each reversibly engaging a switch arm of a respective power transmission member;

a pair of pivoting shaft members, each coupled to a respective one of said pair of switch arm engaging members on one end, and being de-coupleably mounted to a rotatable handle on an opposing end;

an interlocking power activation bar having a pair of openings positionally located on said interlocking power activation bar at a displacement substantially equal to a distance between said switch arms of said power transmission members, whereby rotation of one of said pivoting shaft members engages a switch arm of a respective power transmission member into an "on" position and displaces said interlocking power activation bar transversely to lock the other of said shafts from rotating, thereby preventing both of said switches from being "on" concurrently.

19. The power transmission safety system as recited in claim 18, wherein said door cannot be opened while either of said pair of rotatable handles is in an "on" position.

20. The power transmission safety system as recited in claim 18, wherein said power transmission device is a circuit breaker.

* * * * *